US009012756B1

(12) United States Patent
Goldman et al.

(10) Patent No.: US 9,012,756 B1
(45) Date of Patent: Apr. 21, 2015

(54) APPARATUS AND METHOD FOR PRODUCING VOCAL SOUNDS FOR ACCOMPANIMENT WITH MUSICAL INSTRUMENTS

(71) Applicants: Gerald Goldman, Los Angeles, CA (US); Justin Burrill, Los Angeles, CA (US)

(72) Inventors: Gerald Goldman, Los Angeles, CA (US); Justin Burrill, Los Angeles, CA (US)

( * ) Notice: Subject to any disclaimer, the term of this patent is extended or adjusted under 35 U.S.C. 154(b) by 29 days.

(21) Appl. No.: 13/694,295

(22) Filed: Nov. 15, 2012

(51) Int. Cl.
*G10H 1/36* (2006.01)

(52) U.S. Cl.
CPC ..... *G10H 1/361* (2013.01)

(58) Field of Classification Search
USPC ..... 84/634
See application file for complete search history.

(56) References Cited

U.S. PATENT DOCUMENTS

| | | | | |
|---|---|---|---|---|
| 1,922,239 | A | 4/1931 | Fuschi | |
| 4,633,748 | A | 1/1987 | Takashima et al. | |
| 5,278,346 | A | 1/1994 | Yamaguchi | |
| 5,446,238 | A | 8/1995 | Koyama | |
| 5,557,683 | A * | 9/1996 | Eubanks | 381/86 |
| 5,703,311 | A * | 12/1997 | Ohta | 84/622 |
| 6,630,621 | B1 | 10/2003 | Yamada et al. | |
| 6,657,114 | B2 | 12/2003 | Iwamoto | |
| 6,960,714 | B2 * | 11/2005 | Georges et al. | 84/609 |
| 7,321,094 | B2 | 1/2008 | Sakurada | |
| 7,495,164 | B2 * | 2/2009 | Funaki | 84/609 |
| 7,525,038 | B2 * | 4/2009 | Yamada | 84/626 |
| 7,985,914 | B2 | 7/2011 | Ohba | |
| 8,168,877 | B1 | 5/2012 | Rutledge | |
| 8,173,883 | B2 | 5/2012 | Willacy | |
| 8,324,494 | B1 * | 12/2012 | Packouz | 84/635 |
| 2007/0119292 | A1 | 5/2007 | Nakamura | |
| 2008/0223200 | A1 | 9/2008 | Kwak | |
| 2009/0282965 | A1 | 11/2009 | Matejka | |

FOREIGN PATENT DOCUMENTS

| | | |
|---|---|---|
| JP | 2005049419 | 2/2005 |

OTHER PUBLICATIONS

Vocaloid, Virtud Vocalist Software, web page www.duartstudio.com, date Feb. 13, 2012, 3 pages.
Digitech Vocal-JR, Vocalist Live 5, web page www.jr.com, date Feb. 13, 2012, 2 pages.
Spectrasonics, Virtual Instruments, web page www.spectrasonics.net, date Feb. 13, 2012, 2 pages.
Voxos; Cinesamples, web page http://cinesamples.com, date Feb. 13, 2012, 6 pages.
TC-Helicon, Voice Live Play, web page www.tc-helicon.com, date Feb. 13, 2012, 9 pages.

* cited by examiner

*Primary Examiner* — Christopher Uhlir
(74) *Attorney, Agent, or Firm* — Dennis W. Beech

(57) ABSTRACT

The present invention may be used for producing vocal accompaniment with sound producing musical instruments. A hand operated unit may have a programmable processor, a display, a plurality of control switches and a control device. The hand operated unit may have a selection of human voiced letters in selected pitch and pronunciation characteristics stored in the programmable processor. An identification parameter correlated to a signal from a musical instrument that represents a sound produced by the use of the musical instrument may be stored with each selected human voice letter. When a selected human voice letter is activated, the hand operated unit may output a signal to a sound producing device. The hand operated unit may be connected to a foot operated unit that has multiple two-position foot switches and a pedal for use in control of pitch and sound level characteristics as well as selection of a human voice letter to be sound output.

12 Claims, 4 Drawing Sheets

APPARATUS AND METHOD FOR PRODUCING VOCAL SOUNDS FOR ACCOMPANIMENT WITH MUSICAL INSTRUMENTS

BACKGROUND OF THE INVENTION

This invention relates to apparatus and methods for producing vocal accompaniment with sound producing musical instruments. The new apparatus and method uses recorded alphabet letter sound recordings of individual consonants and vowels as well as combinations of letter sounds in pitched tonal content to be selected in a sequence or randomly by the electronic signals of a played musical instrument to be output with the sounds of the musical instrument.

Systems, apparatus and methods may be known for use in inputting human voice or musical tone sounds, scaling the voice pitch or adjusting instrument tone sounds and controlling the output of separate sounds with chord and pitch control for rhythm and harmony. The apparatus electronics may emphasize the design for automatically generating types of sounds and combining or mixing of sounds for output. The inventions do not disclose the specifics of a letter tone voice system. Voice pitch producing instruments also do not include the specifics of a letter tone voice system.

Other apparatus may generate audio data automatically for generating polyphonic ringtone sounds. The methods of such apparatus do not control individual letter sound for use with musical instruments. There may also be instruments with various controls for functions and switches to manage input sounds with an additional or second sound for harmony sound combination. These apparatus and methods do not deal specifically with letter tone voice sound and musical instrument combination management.

The combining of a sound generating device with a musical instrument being played may be an old concept in the art of music as for example in the U.S. Pat. No. 1,922,239 of Fuschi. This invention has limited electronic structure such as the use of connecting wires to speakers to output sounds in combination with a piano as disclosed. The primarily mechanical device incorporates metal tone disks with styluses mechanically linked to piano keys and connected to a sound box with wires attached to loud speakers or amplifiers. The metal tone disks incorporate five vowel sounds in a generally rudimentary manner.

There may be available software programs for use with musical devices for creating words and phrases for synthesized singing that may use a computer and a midi keyboard. Other devices may store a sample library of sounds, words and phrases designed for a hardware sampler and a midi keyboard. These types of systems may use synthetic or real singing voices to simulate a singer accompanying a musical instrument that is a string instrument.

It appears there is a need for an apparatus and method that is simple for use by musicians in live performances with all types of musical instruments to control pitched tonal letter sounds to be produced while playing an instrument rather than synthetically created or library assembled singers of phrases and songs that may be complicated background singing not manageable in small increments.

SUMMARY OF THE INVENTION

The present invention is directed to apparatus and methods for producing vocal accompaniment with sound producing musical instruments. A hand operated unit may have a programmable processor, a display, a plurality of control switches and a control device. The hand operated unit may have a selection of human voiced letters in selected pitch and pronunciation characteristics stored in the programmable processor. An identification parameter correlated to a signal from a musical instrument that represents a sound produced by the use of the musical instrument may be stored with each selected human voice letter. When a selected human voice letter is activated, the hand operated unit may output a signal to a sound producing device. A foot operated unit may be connected to the hand operated unit with multiple two-position foot switches and a pedal for use in control of pitch and sound level characteristics as well as selection of a human voice letter to be sound output.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
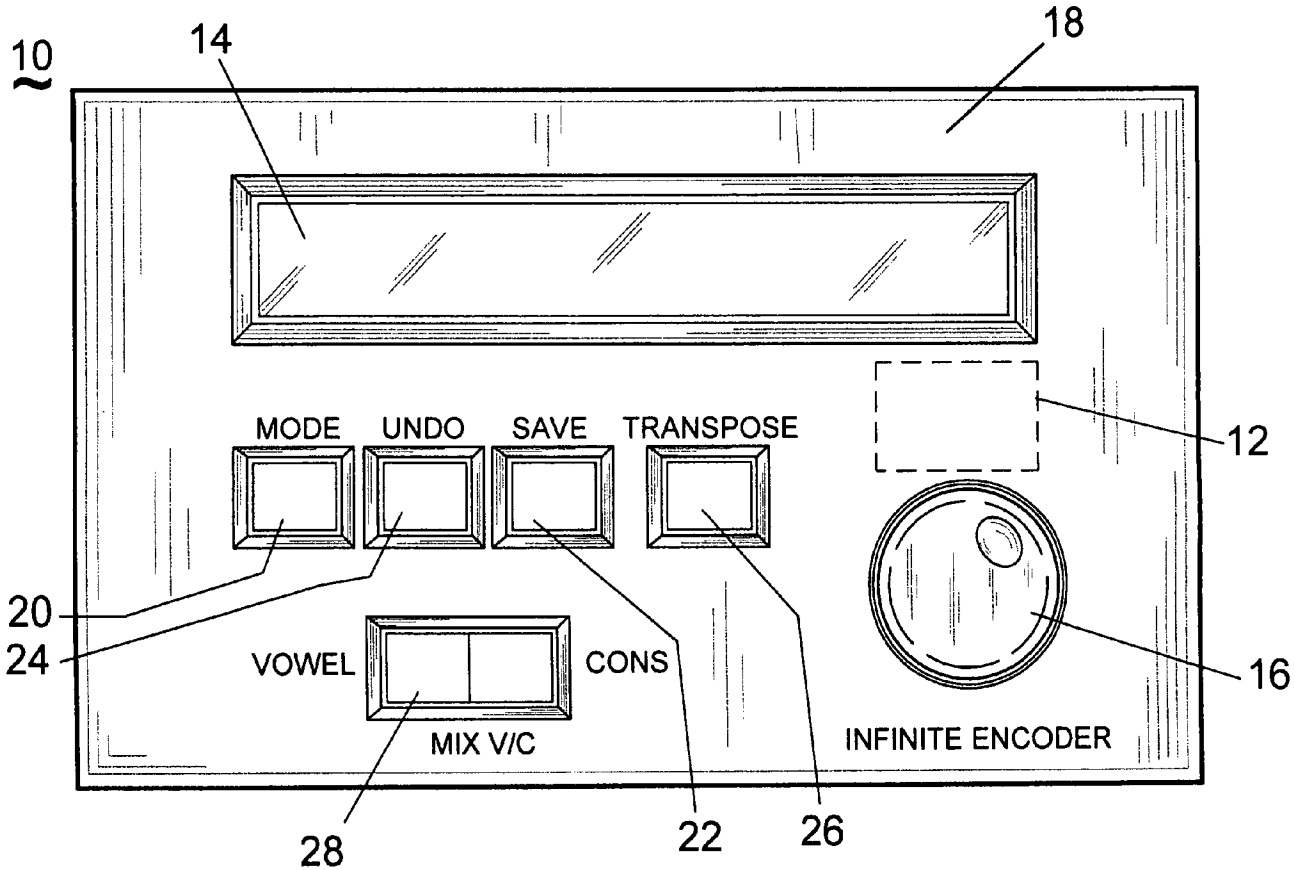
FIG. 1 illustrates a top plan view of a hand operated unit according to an embodiment of the invention.
Figure 2:
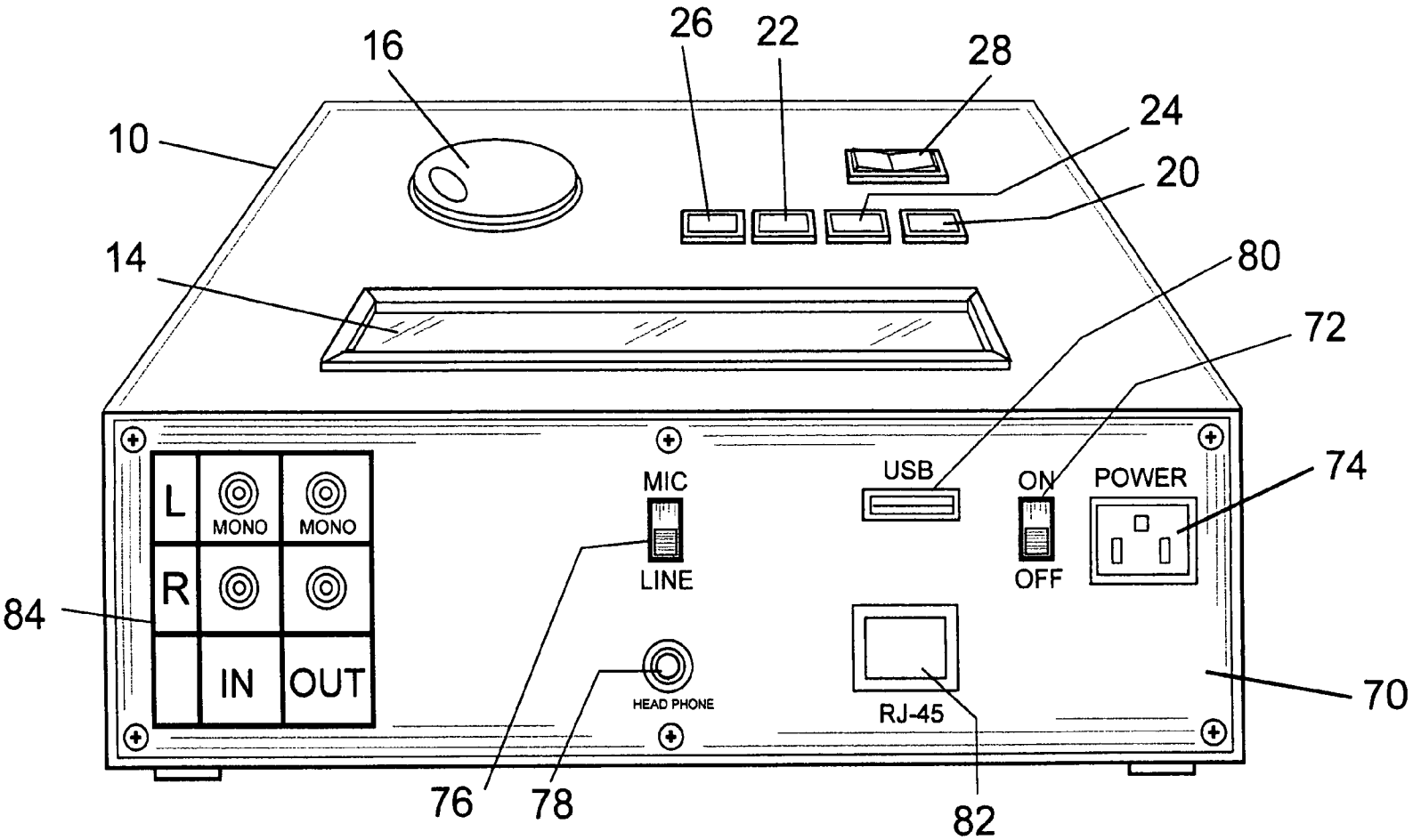
FIG. 2 illustrates a perspective view of a hand operated unit according to an embodiment of the invention.
Figure 3:
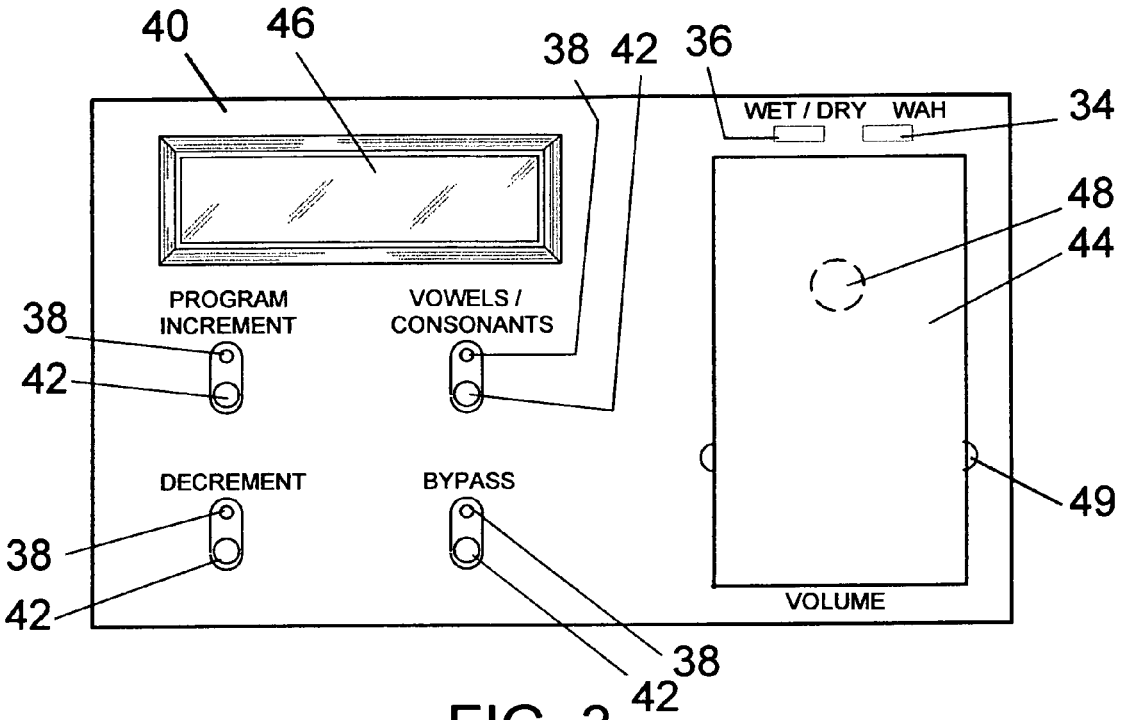
FIG. 3 illustrates a top plan view of a foot operated unit according to an embodiment of the invention.
Figure 4:
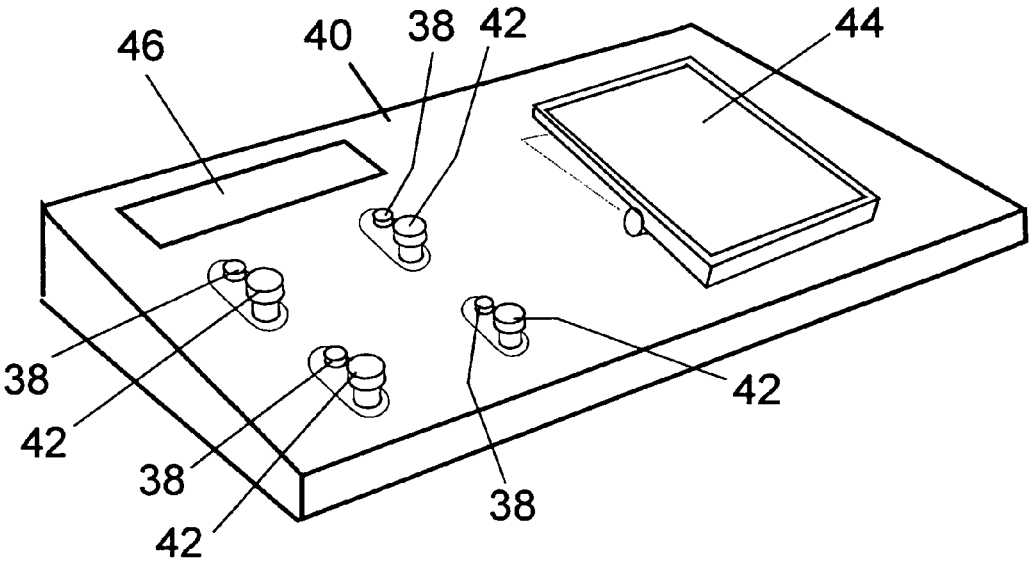
FIG. 4 illustrates a perspective view of a foot operated unit according to an embodiment of the invention.
Figure 5:
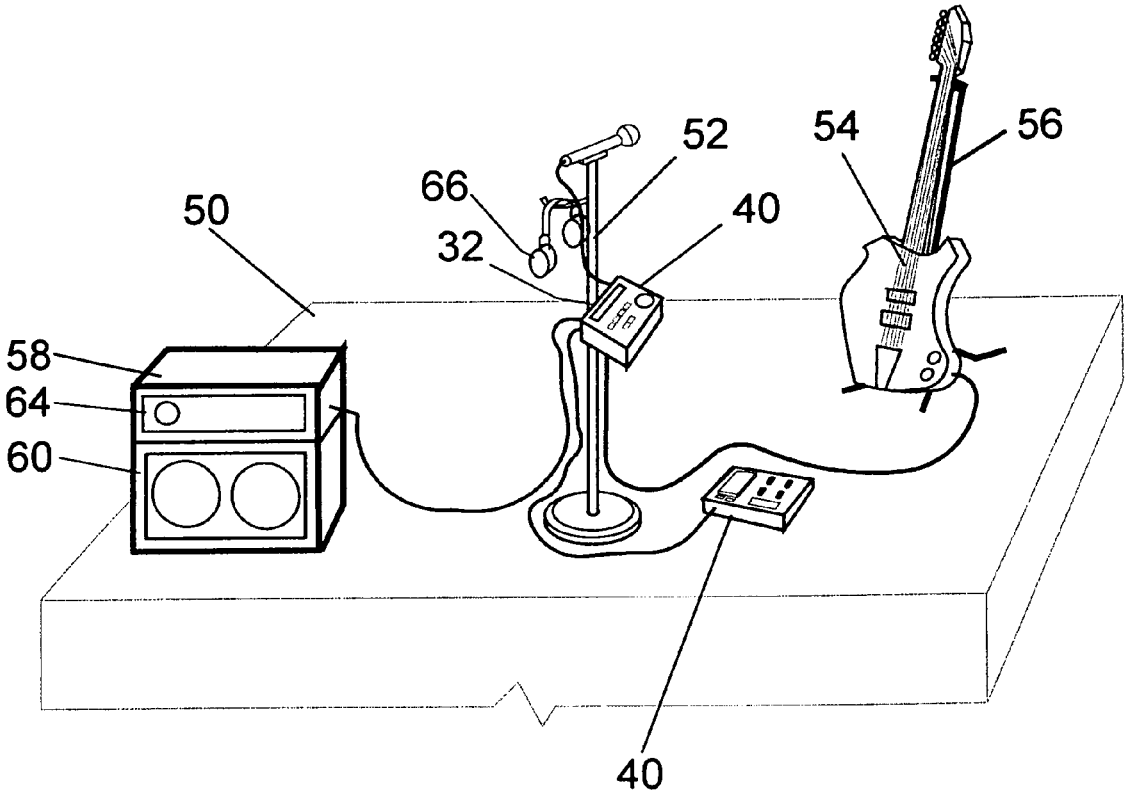
FIG. 5 illustrates a perspective view of a system according to an embodiment of the invention.
Figure 6:
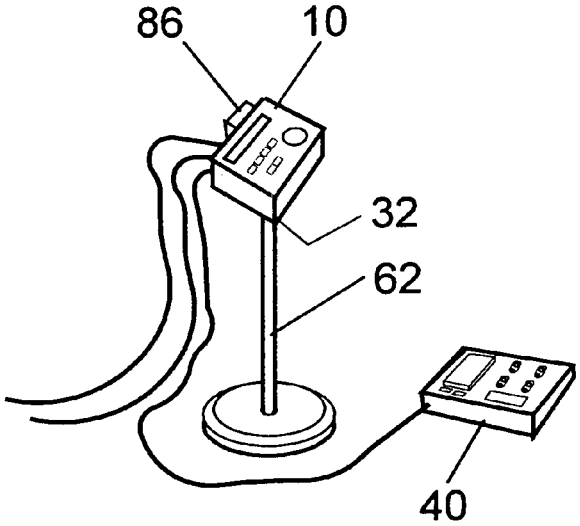
FIG. 6 illustrates a perspective view of a system according to an embodiment of the invention.

Referring to FIGS. 1 through 6, a vocal sound producing system for use by a musician playing a musical instrument 54 in a real time setting such as a live performance, recording or the like situation may have a hand operated unit 10 and a foot operated unit 40. The hand operated unit 10 may have an embedded computer 12 or smart programmable processor with memory, a display 14, multiple switches for control of the modes of a control device 16 to control the display 14 for selection of commands, information storage and retrieval, and interface with external equipment such as general purpose computers. The switches may include a mode switch 20, a save switch 22, an undo switch 24, a transpose switch 26 and a sound selection switch 28. The control device 16 may be in the form of a continuously rotatable disk or wheel that causes the system and display to cycle through available instructions and stored information for selection of an action by means of depressing the disk or an associated switch. The disk may be attached to a rotatable device that sense pressure on an exposed surface of the disk that is accessible on the front panel of the hand operated unit.

The hand operated unit 10 may have a form factor, i.e., size and shape, and control-display panel 18, for ease of use on a performance stage 50 or other live venue. The unit 10 may be attached 32 to a musician's microphone stand 52 or placed adjacent to a microphone or musical instrument location 62. This may allow a musician to change pitched tone sound output while performing.

The information stored in the hand held unit 10 for sound production is a selection of human voiced consonants and vowels that may be letters of the English language alphabet. The recorded letter sounds may be recorded with different pitch using different human voices pronouncing individual letters in variant pronunciations. The long vowels A, E, I, O, U as well as the consonants including Y may be voice recorded in selected variations. The consonants may be further classified as having hard or soft sound quality, i.e., hard; B, D, G, J, K, P, T and soft: F, L, M, N, R, S, V, W, Y, Z; and other consonants may not be used because of similar or redundant sound with other letters, i.e., C, H, Q, X. Samples of the human voice sounding of these letters would be recorded using known recording equipment to record individual letters as well as combinations of each consonant and vowel. The human recordings may include men and women in various level, intensity and quality of pitch.

The voice recorded letters would be stored in the hand operated unit 10 with identification to be selected to be activated or triggered by the sounds produced by the playing of a musical instrument that may be the lead instrument in a band or group, or a single instrument. The sounds of any instrument may be used with the hand operated unit, such as an electric guitar 54 or other electronic instrument, as well as acoustic instruments that may use microphones to convert sound to electronic signals. The coding system to cause the hand operated unit 10 to signal a sound system emission of a letter recorded sound may be the MIDI communication standard specification. Each musical instrument may have sound characteristics identified to cause the triggering or activation of a voice recorded letter sound.

In operation the hand operated unit 10 may be programmed or encoded to function on receipt of signals from a musical instrument as it is played. This may allow a musical performer to encode a hand operated unit 10 for their individual use in performing. Unit 10 may have parameters stored for the expected electronic input to be received for each type of musical instrument that is to be played. The parameters may represent sounds that may be produced by actions with each type of instrument, for example, string bend or vibration, slide, hammer, slapping, trills, vibrato, and others that are known regarding musical instruments.

The coding of the hand operated unit 10 is performed by use of the switches 20, 22, 24, 26, 28, the control device 16, and the display 14. The mode switch 20 may be used to select the program mode to program the unit with preselected voice recorded letters to be activated by the input signals from a musical instrument. The preselected voice recorded letters for a particular parameter of an instrument may be a single letter, a sequence of letters or combinations of letters. The preselects may be triggered sequentially or randomly. The process for coding the unit 10 is to use the control device 16 by rotation clockwise or counter-clockwise in the program mode to display the desired preselect letter and then to depress the control device 16 to record the preselection. When the hand operated unit 10 is in the program mode either when first turned on or when selected by the mode switch 20, all of the recorded letters will be displayed on the display 14 with the sound selection switch 28 in the center position. Depressing the sound selection switch 28 to either side position will select consonants or vowel letters to be displayed on the display 14. The first letter on a display will be highlighted; however, the desired letter to be selected for storing a preselect can be highlighted by rotating the control device 16. To change a preselect the mode switch 20 can be operated to select the program edit mode. The control device 16 may then be used to change preselects and parameters such as volume, attack, sustain, decay and release that may modify a letter sound or the way it is activated by a particular instrument. The control device 16 may be rotated to choose a particular parameter or to select default parameters. Then the control device 16 is depressed to highlight the selection and the save switch 22 can be pressed to store the selection.

The mode switch 20 may also have a global setup mode selection that may allow changing of additional parameters that may include MIDI, threshold, response, attack, hold, decay and sensitivity for a particular musical instrument. The global setup mode may also allow the activation of one type of instrument parameter, for example, guitar parameters, to be triggered by a different instrument such as a woodwind.

The transpose switch 26 may be used to change the pitch of a preselected letter sound or sequence of letter sounds in half-steps or octaves up or down over a selected range as for example up or down two octaves. The pitch limitations may be within the range of the eighty-eight keys of a piano. The undo switch 24 may be used to reverse a saved selection in the instance of a need for correcting a step.

The sound selection switch 28 may be a rocker or 3 position switch for selection of letter sounds of consonant, vowel, and combination consonant-vowel.

The hand operated unit 10 may have a communication panel 70 for control of unit power and communication with other system elements as well as musical instruments, guitar 54 on guitar stand 56, headphones 66, sound amplifier 58 with controls 64 and sound producing device 60, as well as microphones or other devices. The communication panel 70 may have a power switch 72 and power connector 74, a microphone and line cord switch 76, a headphone connector 78, a USB port 80, a foot operated unit connector 82, and a right-left and input-output sound connector panel 84 all connected to the programmable processor module 12.

The foot operated unit 40 will be connected to the hand operated unit 10 by a cable such as an RJ45 telephone cable or other suitable link such as a wireless device 86. The unit 40 may have four to six foot switches 42 and a foot pedal 44. The switches 42 may be two position switches to allow a musician user to use a foot to signal an action to the hand operated unit 10. The switches 42 may have indicators 38 to indicate status such as on-off or other switch condition. Switches 42 may be used to change the foot pedal 44 function, to cause a stored human voiced letter to be activated to cause a sound to be emitted by a sound system, and to affect other functions of the hand operated unit 10.

A foot unit display 46 in the panel of the foot operated unit 40 is positioned above the switches 42. The foot pedal 44 may function as a volume control, to increment or decrement the display of stored human voiced letters, as an on-off, wet-dry 36 mix mode and WAH 34 mode control device, or other like selectable function device based on foot switch 42 settings and the programming of the embedded computer 12 or programmable processor of the hand operated unit 10. The foot pedal 44 may have a sensor switch 48 to sense pedal position or a sensor for a rotational element of the pedal 44.

While the invention has been particularly shown and described with respect to the illustrated embodiments thereof, it will be understood by those skilled in the art that the foregoing and other changes in form and details may be made therein without departing from the spirit and scope of the invention.

We claim:

1. A method for producing vocal accompaniment with sound producing musical instruments comprising:

a) a hand operated unit with a programmable processor module connected to a display on a control-display panel of said hand operated unit, a control device to control said display wherein said control device is a disk attached to a rotatable device that senses pressure on an exposed surface of said disk and said exposed surface is accessible on said control-display panel of said hand operated unit for storing selected data in said programmable processor and a plurality of control switches;

b) activating a mode switch for program mode of said hand operated unit;

c) rotating said control device to highlight a letter on said display and depressing said control device to store a human voiced letter in pitch and pronunciation characteristics;

d) rotating said control device to highlight a musical instrument parameter for identification with said human voiced letter stored and depressing said control device to store said musical instrument parameter with said human voiced letter stored for selection when said hand operated unit receives an input signal from a musical instrument that represents a sound produced by said musical instrument as an identification parameter;

e) repeating actions c) through d) to store a plurality of a human voiced letters in pitch and pronunciation characteristics; and f) outputting a signal for a selected human voiced letter to a sound producing device.

2. The method as in claim 1 further comprising:

activating said mode switch for edit mode of said hand operated unit;

rotating said control device to display one of said musical instrument parameters and depressing said control device to display said human voiced letter in pitch and pronunciation characteristics of said musical instrument parameter displayed;

rotating said control device to highlight a desired human voiced letter in pitch and pronunciation characteristics and depressing said control device to select said desired human voiced letter in pitch and pronunciation characteristics; and activating a save switch to store said desired a human voiced letter in pitch and pronunciation characteristics with said musical instrument parameter.

3. The method as in claim 2 wherein an undo switch is activated to reverse the method of claim 2.

4. The method as in claim 1 wherein after said activation of said mode switch a sound selection switch is activated to select a human voiced letter display list from the group consisting of a consonant and a vowel.

5. The method as in claim 1 wherein after said activation of said mode switch said sound selection switch is activated to select a consonant and vowel letter combination for display.

6. The method as in 1 wherein a foot operated unit is connected to said hand operated unit wherein said foot operated unit has a visual display, at least one foot switch and a foot pedal in communication with said hand operated unit.

7. An apparatus for producing vocal accompaniment with sound producing musical instruments comprising:

a hand operated unit with a programmable processor module connected to a display on a control-display panel of said hand operated unit, a control device to control said display wherein said control device is a disk attached to a rotatable device that senses pressure on an exposed surface of said disk and said exposed surface is accessible on said control-display panel of said hand operated unit for storing selected data in said programmable processor, a mode switch to select a program mode, a save switch for selected data, an undo switch to reverse storing of selected data, a sound selection switch that is a three position switch for selection of consonant, vowel and combination letter sounds to select a letter sound, and a transpose switch to change a pitch of a selected letter sound; and a communication panel on said hand operated unit with a power switch and a power connector, a microphone-line switch, a headphone connector, a USB port, a foot operated unit connector, and a right-left and input-output sound connector panel all connected to said programmable processor module.

8. The apparatus as in claim 7 wherein a foot operated unit has a visual display, a foot pedal with a pedal sensor switch, and at least one foot switch all in communication with said hand operated unit.

9. The apparatus as in claim 8 wherein said hand operated unit and said foot operated unit are connected by a cable.

10. The apparatus as in claim 8 wherein said hand operated unit and said foot operated unit are in communication through a wireless device.

11. The apparatus as in claim 8 wherein said at least one foot switch has a position light indicator.

12. The method as in claim 1 further comprising activating a transposed switch, rotating said control device to select a human voiced letter in pitch and pronunciation characteristics, and operating said transposed switch to change the pitch stored.

* * * * *